US006755773B2

(12) United States Patent
Ospina

(10) Patent No.: US 6,755,773 B2
(45) Date of Patent: Jun. 29, 2004

(54) DOUBLE BOX GLUE AND TAPE MACHINE WITH SEPARABLE CONVEYORS, SEMI-AUTOMATIC ALIGNMENT AND FEED SYSTEM, AND GLUE FLUSHING SYSTEM

(75) Inventor: Luis Ospina, Alpharetta, GA (US)

(73) Assignee: Corrugated Gear & Services, Inc., Alpharetta, GA (US)

( * ) Notice: Subject to any disclaimer, the term of this patent is extended or adjusted under 35 U.S.C. 154(b) by 19 days.

(21) Appl. No.: 10/185,223

(22) Filed: Jun. 28, 2002

(65) Prior Publication Data

US 2004/0005976 A1 Jan. 8, 2004

(51) Int. Cl.[7] ..... B31B 1/62
(52) U.S. Cl. ..... 493/128; 493/131; 493/150
(58) Field of Search ..... 493/128, 150, 493/51, 151, 131, 141; 53/136.4

(56) References Cited

U.S. PATENT DOCUMENTS 4,854,929 A * 8/1989 Szuba ..... 493/150
4,976,672 A * 12/1990 Harrison et al. ..... 493/130
6,012,503 A * 1/2000 Balder ..... 156/578
6,067,773 A * 5/2000 Le ..... 53/387.2
6,221,192 B1 * 4/2001 Walsh ..... 156/257
6,620,086 B2 * 9/2003 Butler et al. ..... 493/141

OTHER PUBLICATIONS

General Taper & Machine Co. (Division of Corrugated Gear and Services, Inc.) . Original Point of Sale advertisement sheet. Alpharetta, Georgia 30004.

* cited by examiner

*Primary Examiner*—Eugene Lee Kim
(74) *Attorney, Agent, or Firm*—Michael J. Mehrman; Mehrman Law Office P.C.

(57) ABSTRACT

A double box glue and tape machine that includes upper and lower seam conveyors with separately positionable gluing conveyors and idler rollers, which allows the idler rollers to be moved out of the way so that the upper and lower seam gluing conveyors may be positioned opposite each other for simultaneous gluing of overlapping seams. The machine also includes a semi-automatic alignment and feed system that includes one or more remotely operable gates for blocking the entrance of a pair of box blanks into the machine to facilitate alignment of the box blanks prior to feeding them into the machine. The alignment and feed system may also include outboard rollers to provide lateral support to the box blanks, input guide rollers to direct the box blanks into the seam conveyors, a seam separator to facilitate separation of the seam around the glue head, and a cold glue flushing system.

5 Claims, 9 Drawing Sheets

DOUBLE BOX GLUE AND TAPE MACHINE WITH SEPARABLE CONVEYORS, SEMI-AUTOMATIC ALIGNMENT AND FEED SYSTEM, AND GLUE FLUSHING SYSTEM

TECHNICAL FIELD

This invention relates to machines for manufacturing cardboard boxes and, more specifically, relates to a double box glue and tape machine with separable conveyors, semi-automatic alignment and feed system, and glue flushing system.

BACKGROUND OF THE INVENTION

In recent years, a need has developed for very large boxes, such as those used to secure a pallet stacked with a quantity of smaller boxes. Double box glue and tape machines have been constructed to manufacture these large boxes by gluing and/or taping together two smaller boxes. To date, however, these machines have proved to be difficult to operate primarily due to the large size and unwieldy nature of the double box blanks that have to be fed into the machine.

More specifically, correctly manufacturing a double box requires proper alignment of the two box blanks before they are fed into the glue and tape machine. Typically, an operator physically aligns the blanks at the input of the machine and then pushes the aligned blanks into the machine, which then propels the blanks through the machine as it applies glue and tape to the seams. But due to the large size of the blanks, obtaining proper alignment is generally difficult and time consuming. This difficulty slows the manufacturing process and increases the number of waste boxes resulting from poor alignment of the box blanks. In addition, many operators of double box machines that are not typically used in very high volume operations cannot justify the high cost of fully automatic alignment and feed systems. For this reason, many operators choose to put up with the inefficiency of a manual alignment system rather than investing in a fully automatic alignment and feed system.

Further, conventional double box glue and tape machines suffer from other drawbacks, such as the inability to glue and tape overlying seams, which may prevent the machine from sealing both seams of a square double box in a single pass. In addition, conventional double box glue and tape machines lack other desirable features that could contribute to increased efficiency, such as a flushing system for the cold glue head.

Therefore, a need exists for a double box glue and tape machine that can simultaneously seal overlying seams for manufacturing square double boxes. A further need exists for cost effective mechanisms to assist an operator in aligning box blanks for a double box glue and tape machine prior to feeding the blanks into the machine. There is a further need for devices to improve the efficiently of double box glue and tape machines.

SUMMARY OF THE INVENTION

The present invention meets the needs described above in a double box glue and tape machine that includes upper and lower seam conveyors with separately positionable gluing conveyors and idler rollers. These independently separable conveyors allow the idler rollers to be moved out of the way so that the upper and lower seam gluing conveyors may be positioned opposite each other for simultaneous gluing of overlapping seams. This feature allows the machine to simultaneously glue overlying seams when manufacturing square double boxes.

Another aspect of the invention includes a semi-automatic alignment and feed system for a double box glue and tape machine. The alignment and feed system includes one or more remotely operable gates for blocking the entrance of a double box blank, consisting of a pair of individual box blanks, into the machine to facilitate alignment of the box blanks prior to feeding them into the machine. The gates are typically operated by a foot pedal located in an operator stand, where the operator can conveniently align the double box blank and then operate the foot pedal to release the gates. A proximity detector typically resets the gates after the box blank clears the input area of the machine. The alignment and feed system may also include additional features to facilitate the alignment and feeding of blanks into the machine, such as outboard rollers to provide lateral support to the box blanks, input guide rollers to direct the box blanks into the seam conveyors, and a seam separator to facilitate separation of the seam around the glue head. The machine may also include a glue flushing system to save time during the clean-up process.

Generally described, the present invention may be embodied in a double box glue and tape machine that includes upper and lower seam conveyors. The upper seam conveyor includes an upper seam gluing conveyor, a lateral positioning system for the upper seam gluing conveyor, an upper seam idler roller, and a lateral positioning system for the upper seam idler roller. Similarly, the lower seam conveyor includes a lower seam gluing conveyor, a lateral positioning system for the lower seam gluing conveyor, a lower seam idler roller, and a lateral positioning system for the lower seam idler roller. This allows the upper seam gluing conveyor to be selectively positioned opposite the upper seam idler roller to glue a first seam, while the lower seam gluing conveyor may be selectively positioned opposite the lower seam idler roller to glue a second seam that is laterally separated from the first seam. Alternatively, the upper seam gluing conveyor may be positioned opposite the lower seam gluing conveyor, with the upper and lower seam idler rollers placed in inoperative positions, to glue first and second seams that are laterally overlapping.

The lateral positioning system for the upper seam gluing conveyor may include a first cross bar having a first rolling surface and rollers supporting the upper seam gluing conveyor carried on the first rolling surface. In addition, the lateral positioning system for the upper seam idler roller may include a second cross bar having a second rolling surface and rollers supporting the upper seam idler roller and carried on the second rolling surface. The lateral positioning system for the lower seam gluing conveyor may include rollers supporting the lower seam gluing conveyor carried on the second rolling surface, while the lateral positioning system for the lower seam idler roller may include rollers supporting the lower seam idler roller and carried on the first rolling surface. That is, the upper seam gluing conveyor and the lower seam idler roller may ride on the first cross bar, while the lower seam gluing conveyor and the upper seam idler roller may ride on the second cross bar. This allows the upper seam gluing conveyor, which is riding on the first cross bar, to be positioned opposite the lower seam gluing conveyor, which is riding on the second cross bar. The double box glue and tape machine may also include a vertical adjustment mechanism operable for adjusting a vertical distance between the first and second cross bars to adjust a nip distance to accommodate box blanks of varying thickness.

The semi-automatic alignment and feed system typically includes one or more remotely operable gates for selectively blocking the entrance of a pair of the box blanks into the seam conveyors and facilitating alignment of the box blanks prior to entry into the seam conveyors. More specifically, the alignment and feed system may include a feed stand for supporting a pair of box blanks adjacent to the input end of the double box glue and tape machine and one or more gates for selectively blocking the entrance of the pair of the box blanks into the input end of the machine and facilitating alignment of the box blanks prior to entry into the machine. The alignment and feed system may also include a release mechanism for remotely releasing the gate to selectively unblock the entrance of the pair of box blanks into the input end of the double box glue and tape machine after alignment.

In particular, the alignment and feed system may include one or more lateral guides supported by the feed gate and configured to cooperate with the gate to facilitate alignment of the box blanks prior to entry into the double box glue and tape machine. In addition, the alignment and feed system may include a box proximity detector, such as an electric eye, configured to reset the gate after the double box blank passes through the input end of the double box glue and tape machine. The release mechanism typically includes a foot pedal carried by an operator stand positioned to facilitate manual alignment and feeding of the box blanks into the double box glue and tape machine.

The alignment and feed system may also include additional features to facilitate the alignment and feeding of blanks into the machine, such as one or more outboard rollers carried by the seam conveyors configured to provide lateral support to the double box blanks passing through the seam conveyors, one or more input guide rollers carried on an input end of the seam conveyor configured to facilitate feeding the double box blanks into the input end of the seam conveyors and a seam separator carried on an input end of the seam conveyors configured to facilitate receipt of a glue head into the seam as the seam passes through the input end of the seam conveyors.

The double box glue and tape machine may also include a cold glue head, a cold glue supply providing cold glue to the cold glue head, a water supply providing water to the cold glue head, and a valve for selectively connecting the cold glue supply and water supply to the cold glue head to facilitate cleaning of the cold glue head.

In a two conveyor system, the double box glue and tape machine typically includes an upper seam conveyor having an upper seam gluing conveyor, a lateral positioning system for the upper seam gluing conveyor, an upper seam idler roller, and a lateral positioning system for the upper seam idler roller. The machine also typically includes a lower seam conveyor having a lower seam gluing conveyor, a lateral positioning system for the lower seam gluing conveyor, a lower seam idler roller, and a lateral positioning system for the lower seam idler roller. The upper seam gluing conveyor may be selectively positioned opposite the upper seam idler roller to glue a first seam, and the lower seam gluing conveyor may be selectively positioned opposite the lower seam idler roller to glue a second seam that is laterally separated from the first seam. Alternatively, the upper seam gluing conveyor may be selectively positioned opposite the lower seam gluing conveyor, with the upper and lower seam idler placed in inoperative positions, to glue first and second seams that are laterally overlapping.

The double box glue and tape machine may also include one or more remotely operable gates for selectively blocking the entrance of a double box blank into the seam conveyor and facilitating alignment of the box blanks prior to entry into the seam conveyor. It may also include one or more outboard rollers carried by the upper seam conveyor configured to provide lateral support to box blanks passing through the upper seam conveyor. Similarly, it may include one or more outboard rollers carried by the lower seam conveyor configured to provide lateral support to box blanks passing through the lower seam conveyor.

The double box glue and tape machine may also include one or more input guide rollers carried on an input end of the upper seam conveyor configured to facilitate feeding box blanks into the input end of the upper seam conveyor. Similarly, it may include one or more input guide rollers carried on an input end of the lower seam conveyor configured to facilitate feeding box blanks into the input end of the lower seam conveyor.

The double box glue and tape machine may also include an upper seam separator carried on an input end of the upper seam conveyor configured to facilitate receipt of an upper glue head into an upper seam as the upper seam passes through the input end of the upper seam conveyor. Similarly, it may include a lower seam separator carried on an input end of the lower seam conveyor configured to facilitate receipt of a lower seam glue head into a lower seam as the lower seam passes through the input end of the lower seam conveyor.

In view of the foregoing, it will be appreciated that the present invention improves on prior double box glue and tape machines by providing separately positionable upper and lower seam gluing conveyors, and a semi-automatic alignment and feed system including remotely operable gates, outboard rollers, guide rollers, and seam separators. The double box glue and tape machine may also include a glue flushing system. The specific techniques and structures employed by the invention to improve over the drawbacks of prior double box glue and tape machines to accomplish the advantages described above will become apparent from the following detailed description of the embodiments of the invention and the appended drawings and claims.

DETAILED DESCRIPTION OF THE EMBODIMENTS

The present invention may be embodied in a double box glue and tape machine that includes upper and lower seam conveyors with separately positionable gluing conveyors and idler rollers. These independently separable conveyors may be included in a new machine, or they may be installed as a retrofit to an existing machine. In addition, the machine may include one conveyor, two conveyors, or a larger number of conveyors if desired. For example, a double box glue and tape machine typically included two conveyors, whereas machines for manufacturing large boxes from three or more box blanks may be constructed with larger numbers of conveyors.

The double box glue and tape machine may also include a semiautomatic alignment and feed system for a double box glue and tape machine. The alignment and feed system includes one or more remotely operable gates for blocking the entrance of a pair of box blanks into the machine to facilitate alignment of the box blanks prior to feeding them into the machine. Again, the semi-automatic alignment and feed system may be deployed as a new machine, or it may be installed as a retrofit to an existing machine. In addition, the machine may include one gate, two gates, or a larger number of gates if desired.

The gates are typically driven by air cylinders, but may alternatively be driven by electric solenoids, gears, ball screws, or any other suitable type of actuators. The gates are typically operated by a foot pedal located in an operator stand, where the operator can conveniently align the box blanks and then operate the foot pedal to release the gate. However, other types of remote activation may be employed, such as a hand lever, a knee pad, a voice response system, or any other suitable type of remote activation system.

A proximity detector typically resets the gate after the box blank clears the input area of the machine. This proximity sensor is typically implemented with an inexpensive electric eye, but alternatively be implemented as a limit switch, a motion detector, or any other suitable type of sensor for detecting the passing of the blank across the input end of the machine. The alignment and feed system may also include additional features to facilitate the alignment and feeding of blanks into the machine, such as outboard rollers to provide lateral support to the box blanks, input guide rollers to direct the box blanks into the seam conveyors, and a seam separator to facilitate separation of the seam around the glue head. The machine may also include a glue flushing system to save time during the clean up process. These features may be deployed in any desirable combination.

Figure 1A:
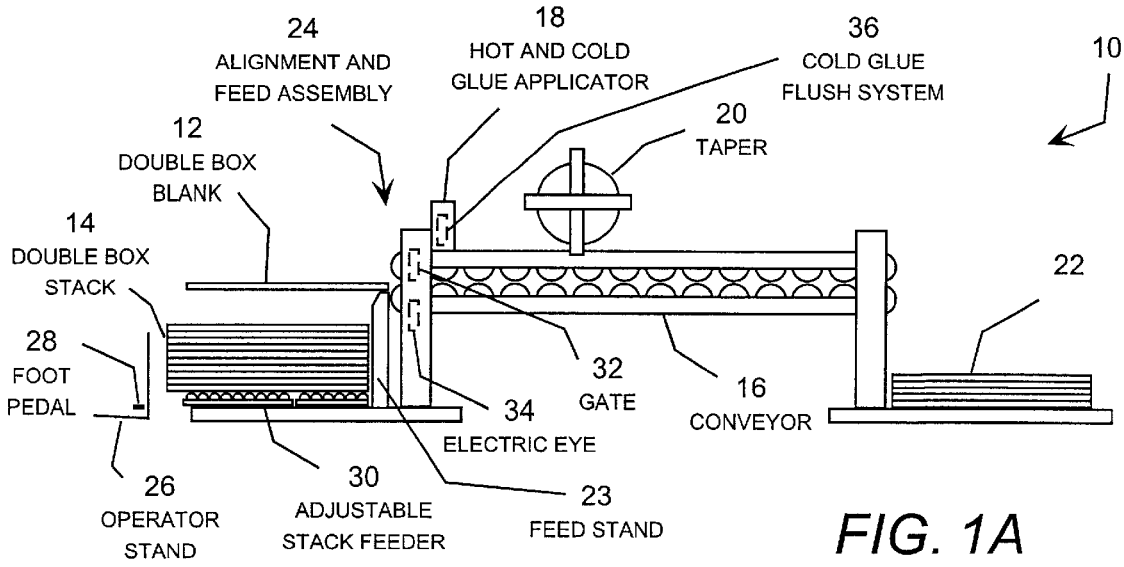
FIGS. 1A, 1B and 1C are plan views of a double box glue and tape machine including a semi-automatic alignment and feed system.
Figure 1B:
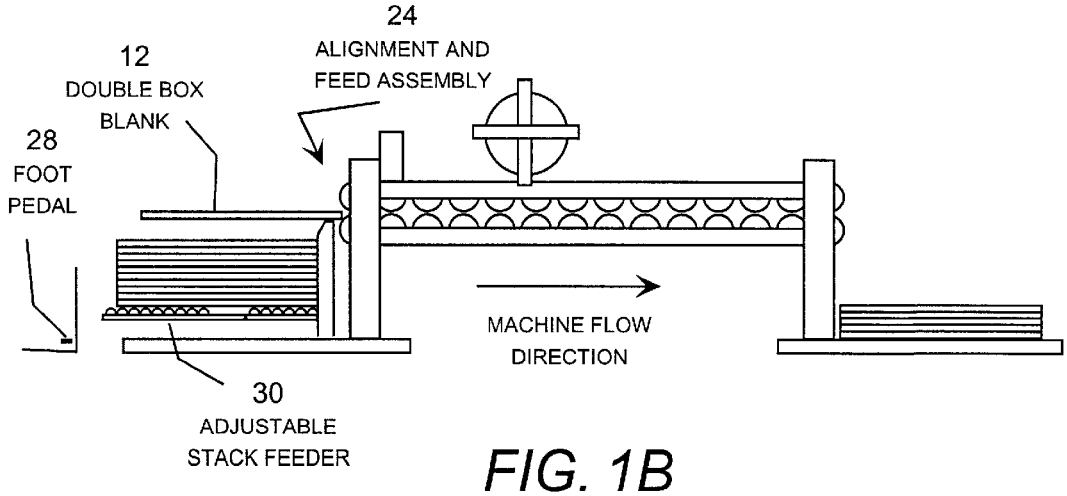
Figure 1C:
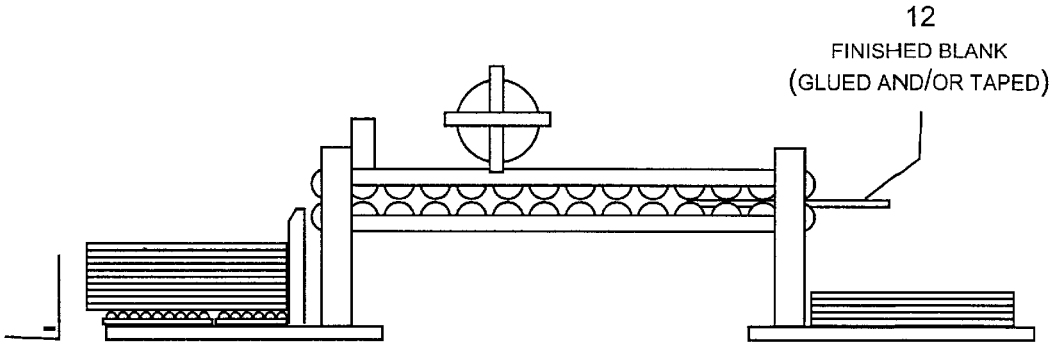

Turning now to the figures, in which like numerals refer to like elements throughout the several figures, FIGS. 1A, 1B and 1C are plan views of a double box glue and tape machine 10 including a semi-automatic alignment and feed system 24. The machine 10 is operative to receive one double box blank 12 (consisting of two box blanks to be glued and/or taped together) at a time from a stack 14 of double box blanks. An adjustable stack feeder 30 lifts the stack 14 of double box blanks to a position that allows an operator to physically lift one blank 12 at a time and place it onto the feed stand 23 while standing behind the stack 14 in an operator stand 26. The operator physically aligns the pair of individual box blanks forming the double box blank 12 while the double blank is supported on the feed stand 23, and then pushes the aligned double blank into the input end of the machine 10.

Each double box blank 12 includes two box blanks, which the machine glues and/or tapes together to construct a double box. To do so, the machine 10 includes a driven conveyor 16, a hot and cold glue applicator 18, and a tape applicator 20. These conventional features of the machine 10, which are well known in the art, may be used to seal a seam with glue and/or tape as the conveyor 16 drives one double box blank 12 at a time though the cold glue applicator 18 and the tape applicator 20. A stack 22 of completed double boxes typically collects at the output end of the machine 10. In addition, the machine 10 may include two gluing conveyors 16 to simultaneously glue and/or tape two seams simultaneously. In this case, the pair of conveyors 16 are typically vertically inverted with respect to each other because the double box blank 12 includes a first seam on the top side of the blank and a second seam on the bottom side of the blank.

As noted previously, correctly manufacturing a double box requires proper alignment of the two box blanks forming the double box blank 12 before the blanks are fed into the glue and tape machine 10. Typically, an operator, who stands in an operator stand 26, physically aligns the blanks while the blanks are supported by the feed stand 23, and then pushes the aligned double blank 12 into the machine 10. The conveyor 16 then propels the blank 12 through the machine as it applies glue and tape to the seams. But due to the large size of the double blank 12, obtaining proper alignment is generally difficult and time consuming. In particular, an operator standing in the operator stand 26 and holding the rear of the double blank can find it difficult to maneuver the blanks into an aligned position before feeding them into the machine 10.

To solve this problem, the machine 10 includes a semi-automatic alignment and feed assembly 24 to assist the operator in aligning the two box blanks forming the double box blank 12 before they are fed into the glue and tape machine 10. The assembly typically includes two gates 32 (one for each conveyor 16) that selectively block passage of the blank 12 into the glue and tape machine 10. These gates provide a pair of stops against which an operator standing in the operator stand 26 can physically brace the double box blank 12 while manipulating the blanks into proper alignment. Once the double box blank 12 is properly aligned, the operator depresses a foot pedal 28 located in the operator stand 26 to release the gate 32. A proximity sensor, such as an electric eye 34, located at the input end of the machine 10 resets the gate 32 to the blocking position when it detects passage of the blank 12.

Figure 2A:
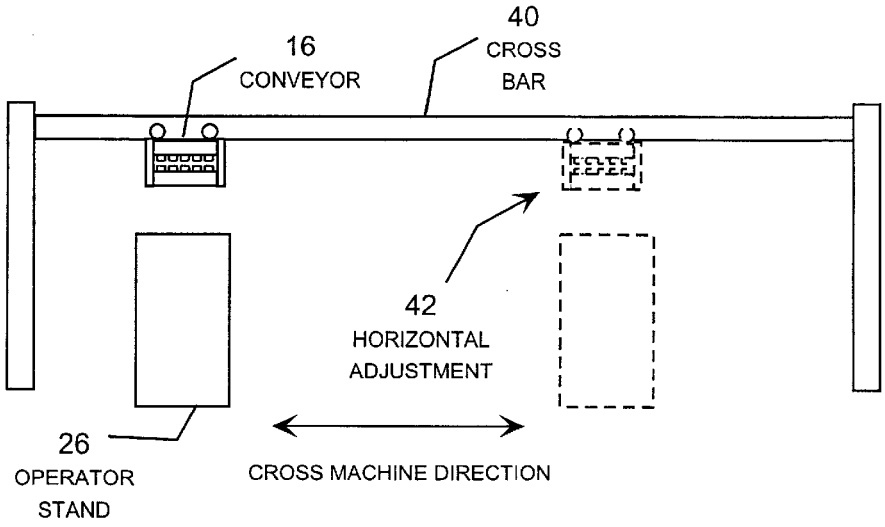
FIG. 2A (PRIOR ART)
FIGS. 2A, 2B and 2C are front views of a prior art double box glue and tape machine.
Figure 2B:
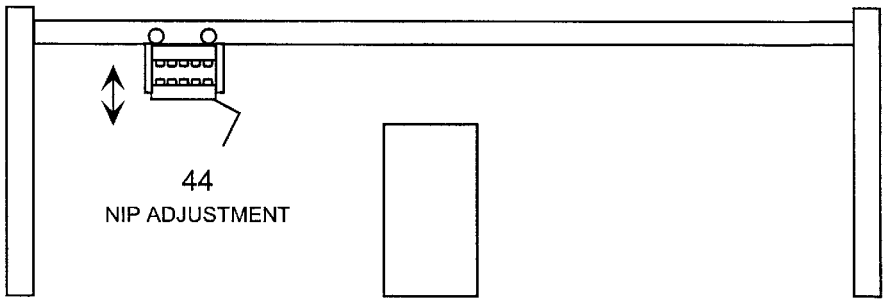
FIG. 2B (PRIOR ART)
Figure 2C:
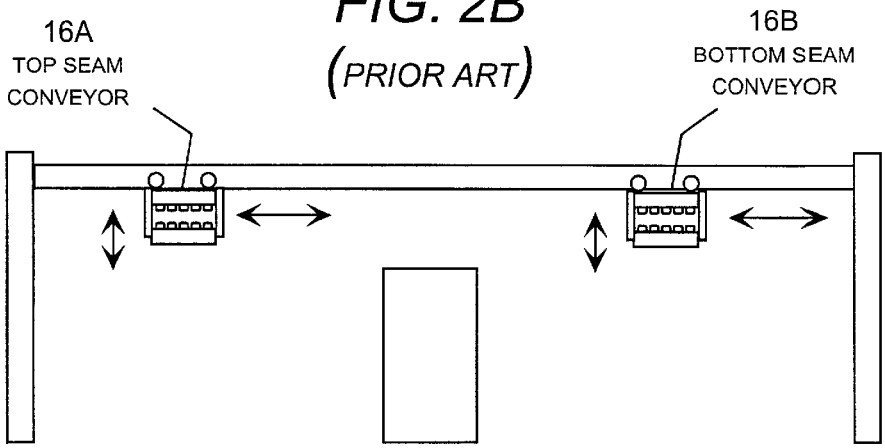
FIG. 2C (PRIOR ART)

FIGS. 2A, 2B and 2C are front views of prior art double box glue and tape machines. FIG. 2A illustrates a machine with a single conveyor 16, which may be moved laterally along a cross bar 40. As shown in FIG. 2B, the conveyor 16 typically includes a gluing conveyor (e.g., upper section) and an idler roller (e.g., lower section) with a nip adjustment mechanism to accommodate blanks of different thickness, such as single, double, and triple wall cardboard. Although this machine works well for sealing one seam at a time, it cannot simultaneously seal two seams to complete a double box in a single pass through the machine. FIG. 2C illustrates a prior art machine with two conveyors 16A and 16B, which allows the machine to seal two laterally separated seams simultaneously. However, the conveyors 16A and 16B do not include independently separable upper and lower sections (i.e., independently separable gluing conveyors and idler rollers). Therefore, the gluing conveyors for each conveyor 16 cannot be positioned vertically opposite to each other for simultaneously sealing overlying seams, which may prevent the machine from sealing both seams of a square double box in a single pass.

Figure 3A:
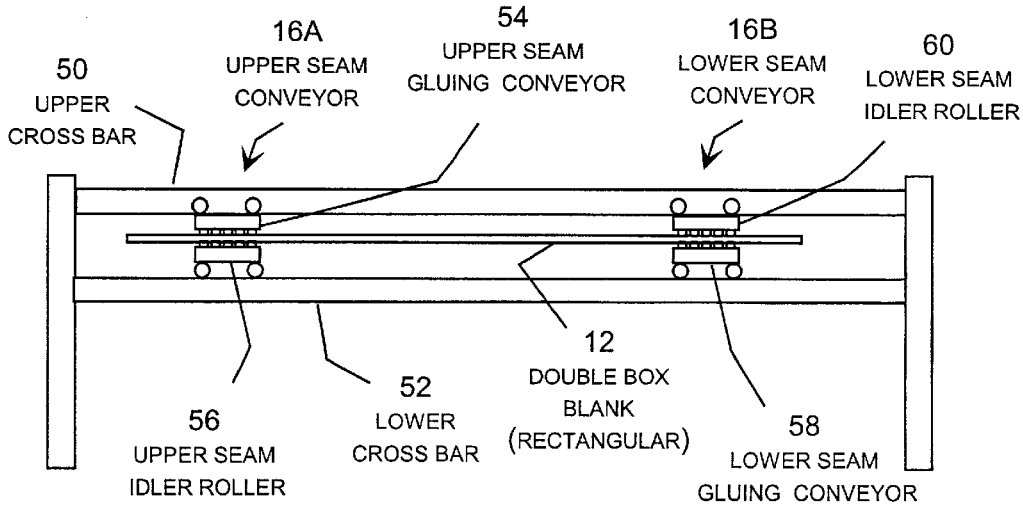
FIG. 3A is a front view of a double box glue and tape machine.
Figure 3B:
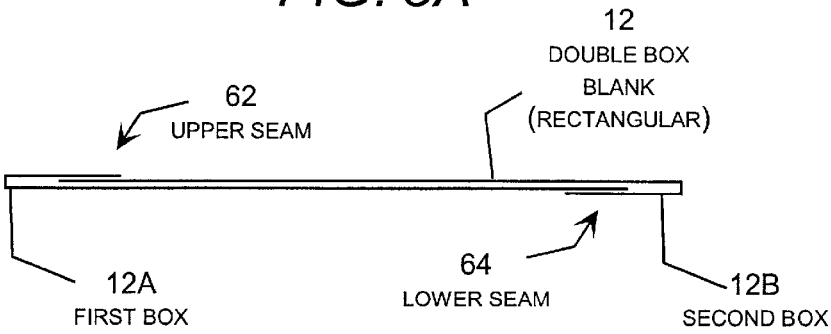
FIG. 3B is a front view of a double box blank with laterally separated upper and lower seams.
Figure 3C:
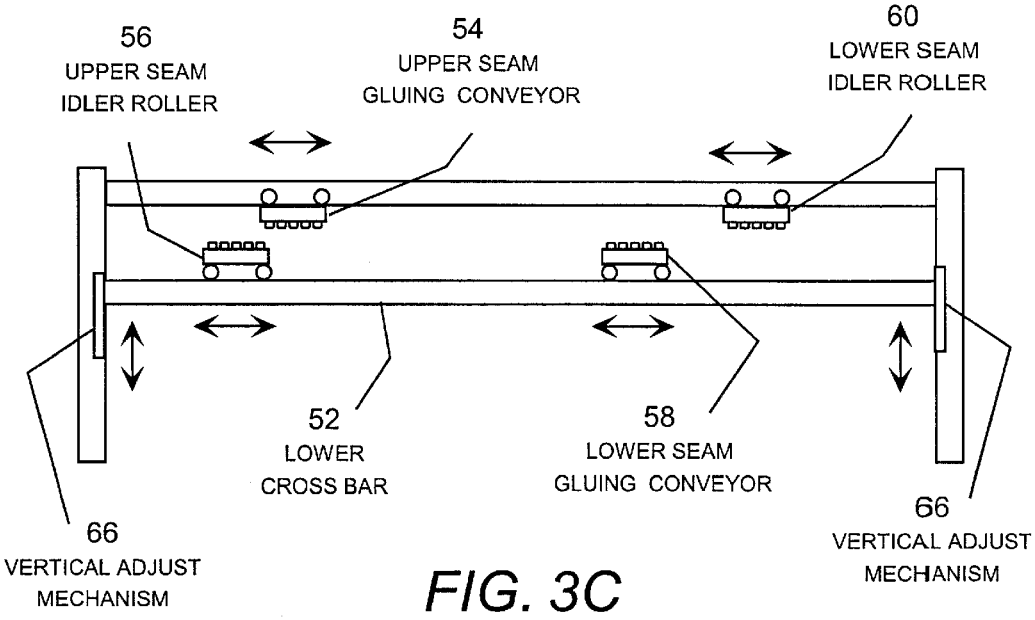
FIG. 3C is a front view of a double box glue and tape machine and box blank with separately positionable upper and lower seam gluing conveyors.

This drawback is solved by the machine illustrated by FIGS. 3A and 3C, which are front views of a double box glue and tape machine and box blank with separately positionable upper and lower seam gluing conveyors 54, 60. FIG. 3B is a front view of a double box blank 12 with laterally separated upper and lower seams 62, 63. The upper seam conveyor 16A includes an upper seam gluing conveyor 54 that rides on an upper cross bar 50. The upper seam gluing conveyor 54 includes hot and cold glue heads for applying glue to an upper box seam as the double box blank 12 passes along the upper seam gluing conveyor. The upper seam conveyor 16A also includes an upper seam idler roller 56 that rides on a lower cross bar 52.

The lower seam conveyor 16B includes a lower seam gluing conveyor 58 that rides on the lower cross bar 52. The lower seam gluing conveyor 58 includes hot and cold glue heads for applying glue to a lower box seam as the double box blank 12 passes along the lower seam gluing conveyor. The lower seam conveyor 16B also includes a lower seam idler roller 60 that rides on the upper cross bar 50. That is, the upper and lower seam conveyors 16A and 16B are vertically inverted with respect to each other so that the upper seam gluing conveyor 54 can seal an upper seam 62 located on the upper side of the double box blank 12, while the lower seam gluing conveyor 58 seals a lower seam 64 located on the bottom side of the blank 12. This opposing configuration of the seams is shown best in FIG. 3B, in which the upper and lower seams are laterally separated from each other as typically occurs in a rectangular double box.

The double box glue and tape machine also includes a vertical nip adjustment 66, such as a worm gear or eccentric cam, for raising and lowering the lower cross bar 52 to adjust the conveyor nip distance to accommodate boards of varying thickness, such as single wall, double wall and triple wall board.

However, when the double box is square rather than rectangular, the upper and lower seams typically overlie each other vertically. To accommodate this situation, the upper seam gluing conveyor 54, which rides on the upper cross bar 50, is separable from the upper seam idler roller 56, which rides on the lower cross bar 52. Similarly, the lower seam gluing conveyor 58, which rides on the lower cross bar 52, is separable from the lower seam idler roller 60, which rides on the upper cross bar 50, as shown in FIG. 3C.

Figure 4A:
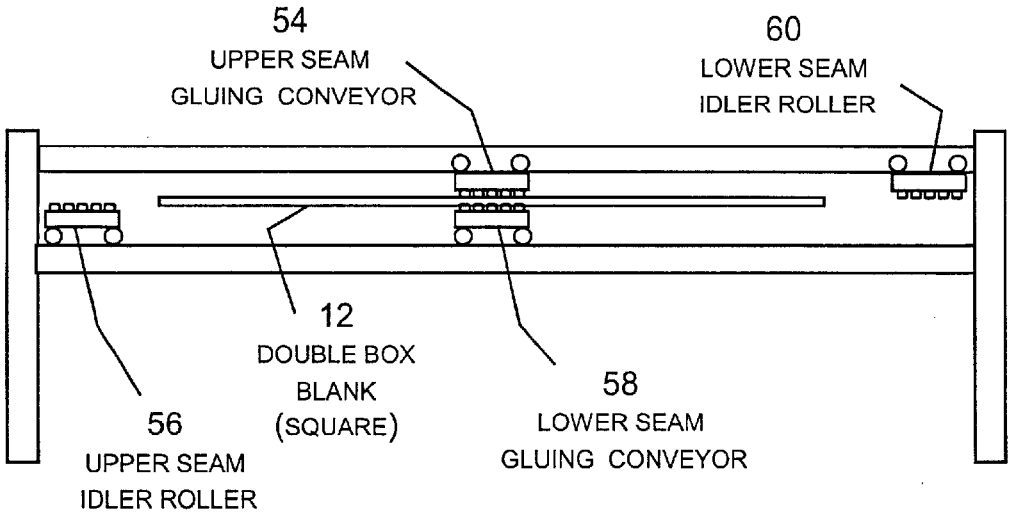
FIG. 4A is front view of a double box glue and tape machine with separately positionable upper and lower seam gluing conveyors configured to seal overlying seams.
Figure 4B:
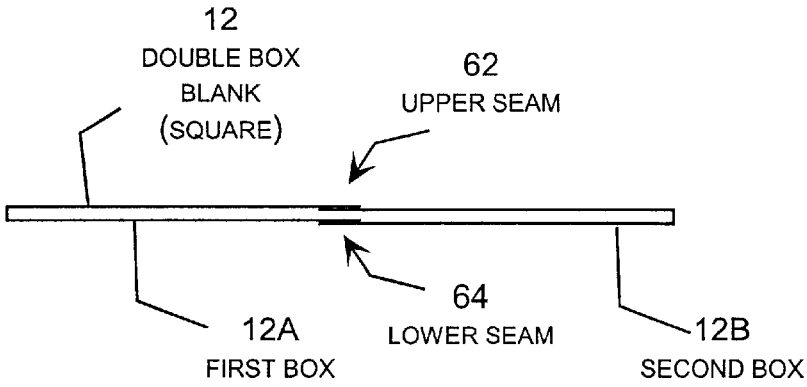
FIG. 4B is front view of a pair of box blanks having overlying seams for receipt in the double box glue and tape machine of FIG. 4A.

To further illustrate the use of the machine in manufacturing square double boxes, FIG. 4A is front view of a double box glue and tape machine with separately positionable upper and lower seam gluing conveyors configured to seal overlying seams. Specifically, the upper seam gluing conveyor 54 is positioned vertically opposite to the lower seam gluing conveyor 58, with the upper and lower seam idler rollers 56, 60 moved out of the way, for simultaneously sealing overlying upper and lower seams, as shown in FIG. 4A. FIG. 4B is front view of a pair of box blanks having overlying seams 62 and 64 for receipt in the double box glue and tape machine of FIG. 4A.

Figure 5A:
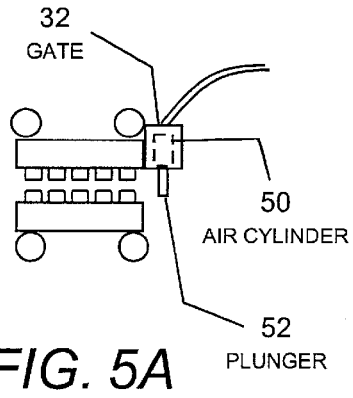
FIGS. 5A and 5B are front views of a conveyor for a double box glue and tape machine including a remotely operable gate.
Figure 5B:
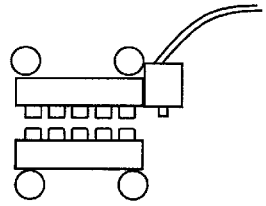
Figure 5C:
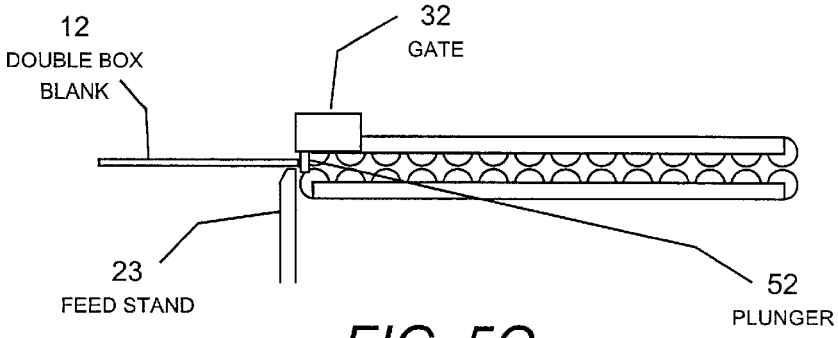
FIG. 5C is a side view of the conveyor and remotely operable gate shown in FIGS. 5A and 5B.
Figure 5D:
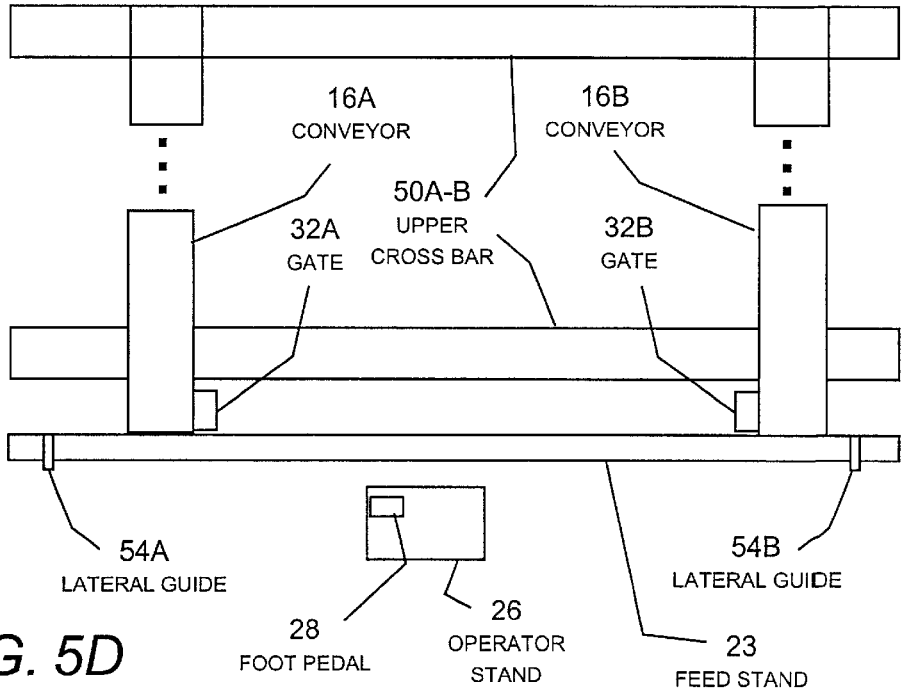
FIG. 5D is a top view of the conveyor and remotely operable gate shown in FIGS. 5A, 5B and 5C.

FIGS. 5A and 5B are front views of a conveyor for a double box glue and tape machine 10 including a pair of remotely operable gates 32. FIG. 5C is a side view, and FIG. 5D is a top view, showing that the machine includes two remotely operable gates 32A and 32B, which are supported by conveyors 16A and 16B, respectively. The gates 32A and 32B are typically mounted to the sides of the conveyors 16A and 16B, respectively, toward the input end of the machine 10 adjacent to the feed stand 23. In this embodiment, each gate 32 includes an air cylinder 50 for selectively extending and retracting a plunger 52.

Specifically, the plunger 52 is retracted in response to a signal from the foot pedal 28 and reset to the extended position in response to a signal from the electric eye 34 (shown in FIG. 1A). As shown in FIG. 5D, the top edge of the feed stand 23 includes two moveable lateral guides 54A and 54B, which can be moved along the top edge of the feed stand 23 to correspond to the desired width of the double box blank 12 to be fed into the machine 10. The lateral guides 54A and 54B provide side surfaces, while the gates 32A and 32B provide end surfaces, to assist the operator in aligning the double box blank 12 prior to depressing the foot pedal 28 and feeding the blank into the machine 10.

Figure 6A:
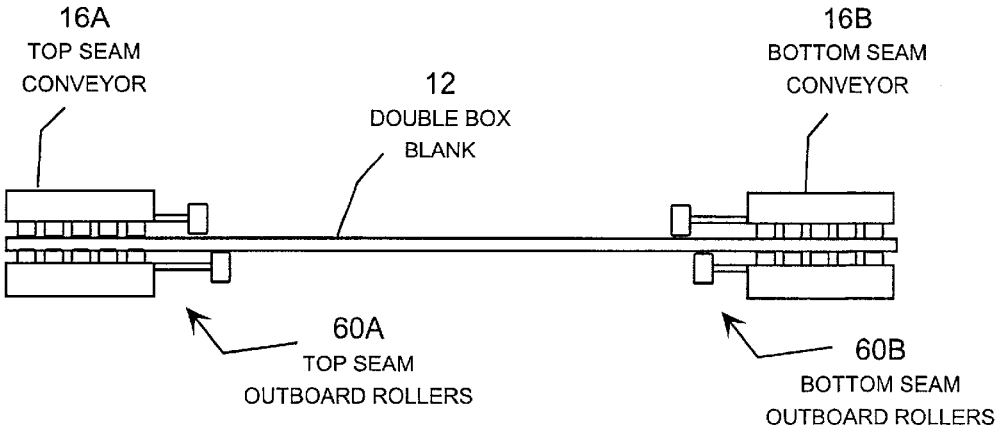
FIG. 6A is a front view of a double box glue and tape machine including outboard rollers.
Figure 6B:
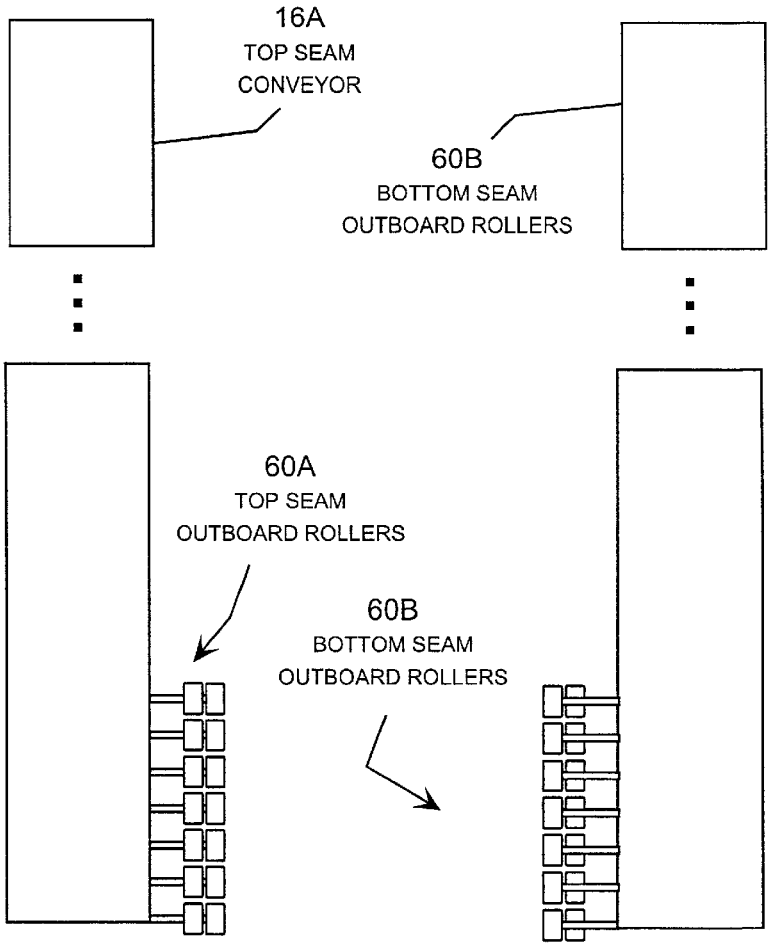
FIG. 6B is a top view of the double box glue and tape machine of FIG. 6A including outboard rollers.

FIG. 6A is a front view, and FIG. 6B is a top view, of a double box glue and tape machine including outboard rollers 60A and 60B. A first set of outboard rollers 60A is carried by the conveyor 16A and second set of outboard rollers 60B is carried by the conveyor 16B. The outboard rollers 60A and 60B extend laterally toward the center of the machine 10 to provide lateral support to the double box blank 12. In particular, the outboard rollers 60A and 60B may be used to provide lateral support to the double box blank 12 during toward the input end of the conveyors, where the glue is applied, to provide extra support until the hot glue sets. The hot glue, which sets very quickly, then holds the double box together while the slower-setting, but stronger, cold glue sets. Typically, relatively small spots or strips of hot glue are applied to tack the seam together while a wider continuous band of cold clue sets. The outboard rollers 60A and 60B may be formed of any suitable material, such as urethane, rubber or the like, and are typically located on steel shafts that extend from a conveyor 16A or 16B. The rollers may be driven or idler rollers.

Figure 7A:
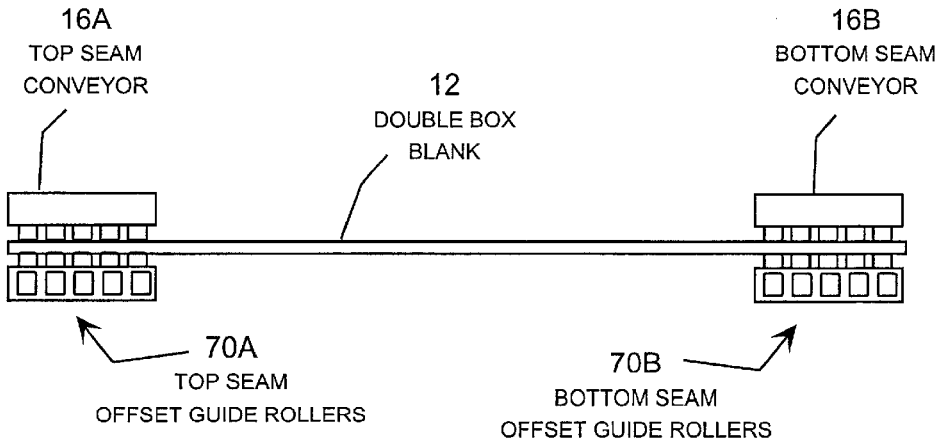
FIG. 7A is a front view of a double box glue and tape machine including input guide rollers.
Figure 7B:
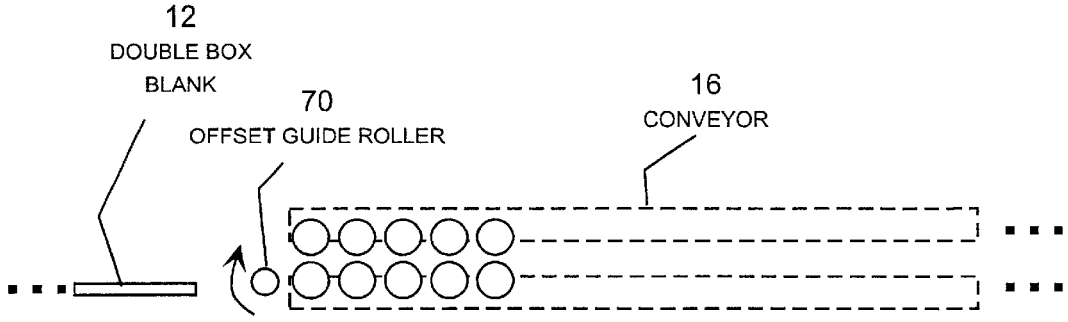
FIGS. 7B, 7C and 7D are side views of the double box glue and tape machine of FIG. 7A including input guide rollers.
Figure 7C:
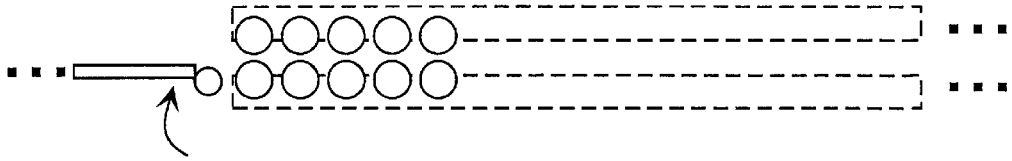
Figure 7D:
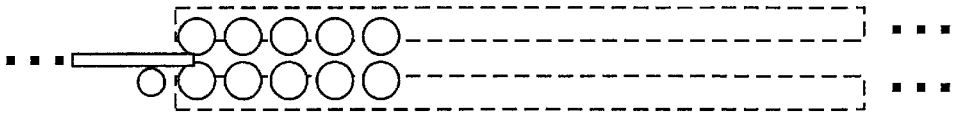

FIG. 7A is a front view of a double box glue and tape machine including input guide rollers 70A and 70B. FIGS. 7B, 7C and 7D are side views of the double box glue and tape machine of FIG. 7A including input guide rollers 70A and 70B. A first set of input guide rollers 70A is positioned adjacent to the input end of the conveyor 16A and second set of input guide rollers 70B is positioned adjacent to the input end of the conveyor 16B. The input guide rollers 70A and 70B help to direct the double box blank 12 into the conveyors 16A and 16BB, as shown in FIGS. 7B, 7C and 7D. The input guide rollers 70A and 70B may be formed of any suitable material, such as urethane, rubber or the like. The rollers may be driven or idler rollers.

Figure 8A:
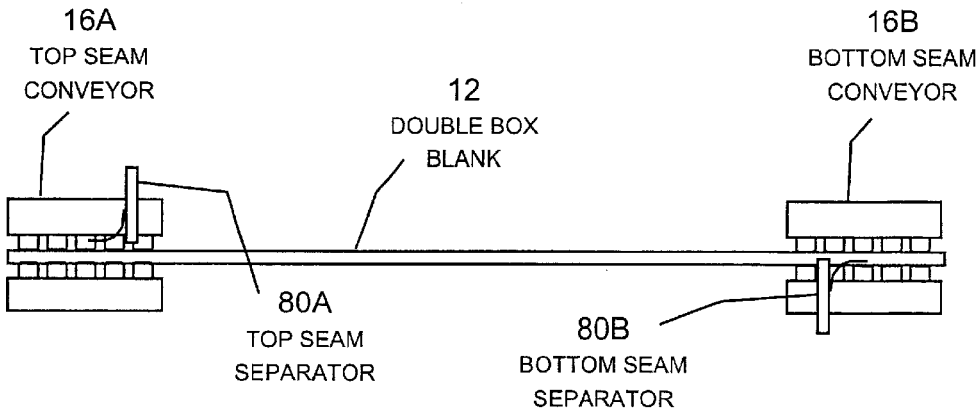
FIG. 8A is a front view of a double box glue and tape machine including top and bottom seam separators.
Figure 8B:
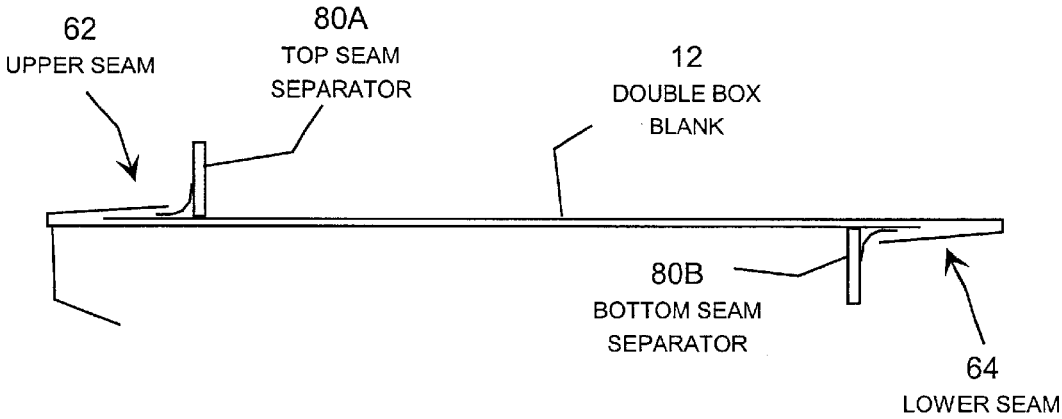
FIG. 8B is a front view of a pair of box blanks illustrating the function of the seam separators shown in FIG. 8A.
Figure 8C:
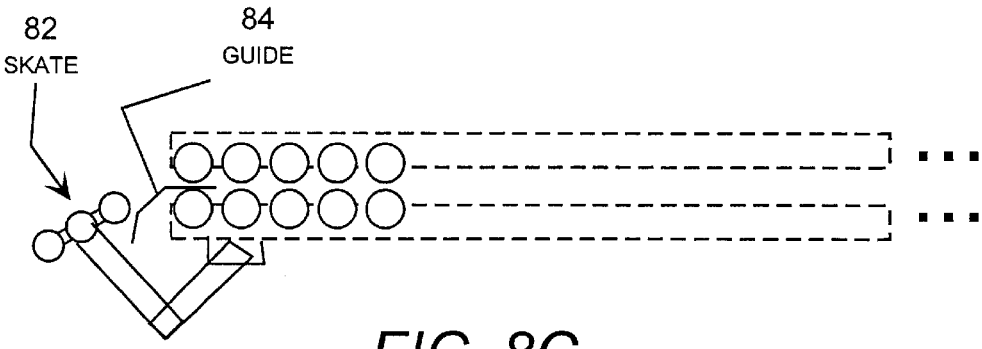
FIG. 8C is a side view of one of the seam separators of FIG. 8A.

FIG. 8A is a front view of a double box glue and tape machine including top and bottom seam separators 80A and 80B. FIG. 8B is a front view of a pair of box blanks illustrating the function of the seam separators shown in FIG. 8A. FIG. 8C is a side view of one of the seam separators of FIG. 8A. A first seam separator 80A is positioned adjacent to the input end of the conveyor 16A and a second seam separator 80B is positioned adjacent to the input end of the conveyor 16B. Each seam separator includes a skate 82 and a guide 84 positioned adjacent to the skate toward the center of the machine 10. The skate 82 is positioned to press against the inner side of a seam while the guide 84 slides into the seam to guide the seam around an associated glue head. In particular, the top seam separator 80A presses down against the top side of the inner portion of the double box blank 12 while the guide 84A slides into the upper seam 62. At the same time, a bottom seam separator 80B presses up against the bottom side of the inner portion of the double box blank while the guide 84B slides into the lower seam 64.

The skate 82 typically includes three steel rollers on a linear support that is positioned at an angle with respect to the blank 12. However, rollers may be formed of any other suitable material, such as urethane, rubber or the like. The rollers may be driven or idler rollers. The guide 84 is typically a formed steel shim that curves both inward into the seam and away from the blank 12 in the same general direction that the skate 82 inclines. This configuration permits the guide 84 to slide into the seam in the blank 12 as the skate 82 comes into contact with the blank 12. In some applications, the machine may operate properly with only the bottom seam separator 80B because only the bottom seam tends to be pressed closed by the weight of the double box blank 12.

Figure 9:
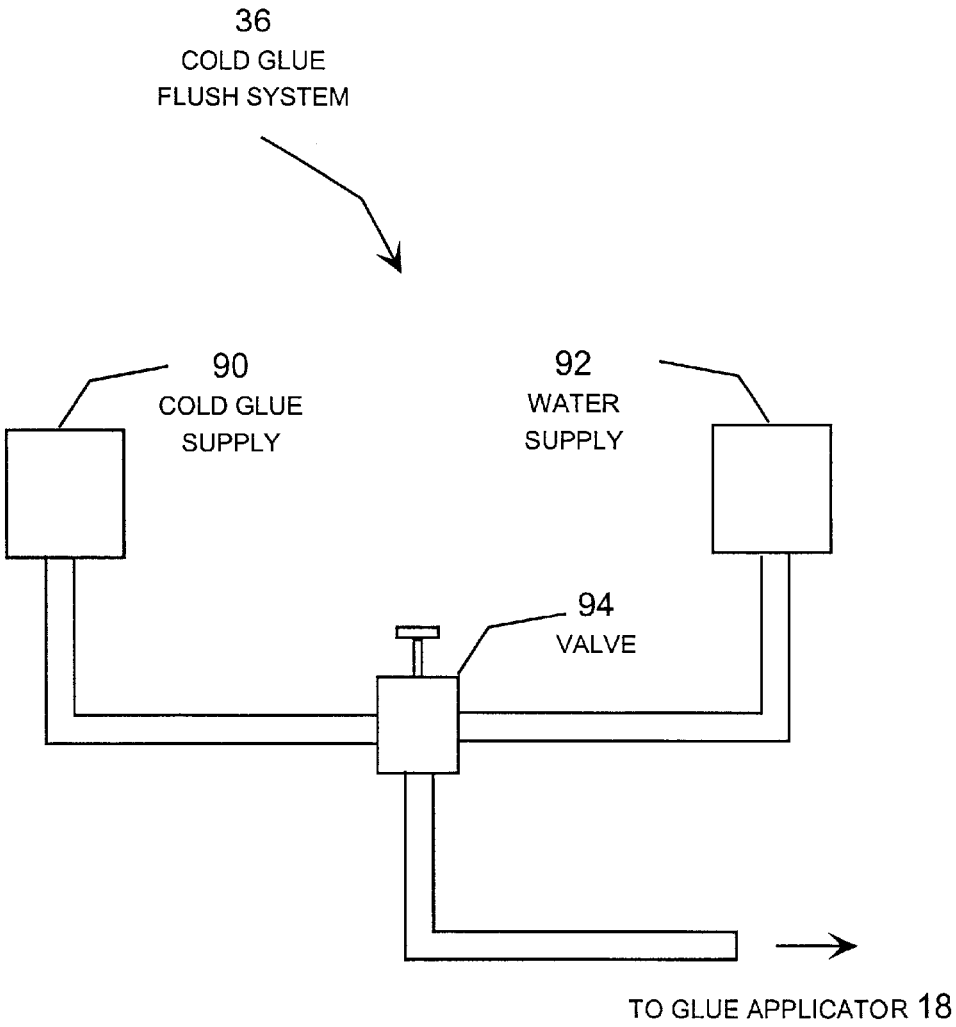
FIG. 9 is a block diagram of a glue flushing system for a double box glue and tape machine.

FIG. 9 is a block diagram of a glue flushing system 36 for a double box glue and tape machine. The glue flushing system 36 includes a cold glue supply 90, a water supply 92, and a valve 94 for selectively connecting either the glue supply 90 or the water supply 92 to the cold glue head of the double box glue and tape machine. The glue flushing system 36 allows easy cleaning of the cold glue head when the machine 10 is shut down for a period of time. The hot glue head, on the other hand, does not benefit from a flushing system because the hot glue does not set unless heated, which prevents the hot glue from setting inside the glue head without flushing.

In view of the foregoing, it will be appreciated that present invention provides an improved double box glue and tape machine with separable conveyors, semi-automatic alignment and feed system, and glue flushing system. It should be understood that the foregoing relates only to the exemplary embodiments of the present invention, and that numerous changes may be made therein without departing from the spirit and scope of the invention as defined by the following claims.

The invention claimed is:

1. A double box glue machine, comprising:

an upper seam conveyor comprising an upper seam gluing conveyor, a lateral positioning system for the upper seam gluing conveyor comprising a first cross bar comprising a first rolling surface and rollers supporting the upper seam gluing conveyor carried on the first rolling surface, an upper seam idler roller, and a lateral positioning system for the upper seam idler roller comprising a second cross bar comprising a second rolling surface and rollers supporting the upper seam idler roller and carried on the second rolling surface;

a lower seam conveyor comprising a lower seam gluing conveyor, a lateral positioning system for the lower seam gluing conveyor, a lower seam idler roller, and a lateral positioning system for the lower seam idler roller;

the upper seam gluing conveyor being selectively positionable opposite the upper seam idler roller to glue a first seam, and the lower seam gluing conveyor being selectively positionable opposite the lower seam idler roller to glue a second seam that is laterally separated from the first seam; and the upper seam gluing conveyor being selectively positionable opposite the lower seam gluing conveyor, with the upper and lower seam idler rollers placed in inoperative positions, to glue first and second seams that are laterally overlapping.

2. The double box glue machine of claim 1, wherein:

the lateral positioning system for the lower seam gluing conveyor comprises rollers supporting the lower seam gluing conveyor carried on the second rolling surface; and the lateral positioning system for the lower seam idler roller comprises rollers supporting the lower seam idler roller and carried on the first rolling surface.

3. The double box glue machine of claim 2, further comprising a vertical adjustment mechanism operable for adjusting a vertical distance between the first and second cross bars to adjust a nip distance to accommodate box blanks of varying thickness.

4. A double box glue machine, comprising:

an upper seam conveyor comprising an upper seam gluing conveyor, a lateral positioning system for the upper seam gluing conveyor comprising a first cross bar comprising a first rolling surface and rollers supporting the upper seam gluing conveyor carried on the first rolling surface, an upper seam idler roller, and a lateral positioning system for the upper seam idler roller comprising a second cross bar comprising a second rolling surface and rollers supporting the upper seam idler roller and carried on the second rolling surface;

a lower seam conveyor comprising a lower seam gluing conveyor, a lateral positioning system for the lower seam gluing conveyor, a lower seam idler roller, and a lateral positioning system for the lower seam idler roller;

the upper seam gluing conveyor being selectively positionable opposite the upper seam idler roller to glue a first seam, and the lower seam gluing conveyor being selectively positionable opposite the lower seam idler roller to glue a second seam that is laterally separated from the first seam;

the upper seam gluing conveyor being selectively positionable opposite the lower seam gluing conveyor, with the upper and lower seam idler rollers placed in inoperative positions, to glue first and second seams that are laterally overlapping; and one or more remotely operable gates for selectively blocking the entrance of a pair of the box blanks into the seam conveyor and facilitating alignment of the box blanks prior to entry into the seam conveyor.

5. The double box glue machine of claim 4, further comprising:

one or more outboard rollers carried by the upper seam conveyor configured to provide lateral support to box blanks passing through the upper seam conveyor;

one or more outboard rollers carried by the lower seam conveyor configured to provide lateral support to box blanks passing through the lower seam conveyor;

one or more input guide rollers carried on an input end of the upper seam conveyor configured to facilitate feeding box blanks into the input end of the upper seam conveyor;

one or more input guide rollers carried on an input end of the lower seam conveyor configured to facilitate feeding box blanks into the input end of the lower seam conveyor;

an upper seam separator carried on an input end of the upper seam conveyor configured to facilitate receipt of an upper glue head into an upper seam as the upper seam passes through the input end of the upper seam conveyor; and a lower seam separator carried on an input end of the lower seam conveyor configured to facilitate receipt of a lower seam glue head into a lower seam as the lower seam passes through the input end of the lower seam conveyor.

* * * * *